United States Patent [19]

Jozefozak

[11] Patent Number: 4,606,146

[45] Date of Patent: Aug. 19, 1986

[54] SLIDING VEHICLE DOOR

[75] Inventor: Thadius F. Jozefozak, Warren, Mich.

[73] Assignee: General Motors Corporation, Detroit, Mich.

[21] Appl. No.: 761,202

[22] Filed: Jul. 31, 1985

[51] Int. Cl.[4] ..... E05D 15/10

[52] U.S. Cl. ..... 49/216; 49/225

[58] Field of Search ..... 49/215, 216, 218, 221, 49/225

[56] References Cited

U.S. PATENT DOCUMENTS

| | | | |
|---|---|---|---|
| 3,501,864 | 3/1970 | Erb et al. | 49/215 |
| 3,520,083 | 7/1970 | Erb et al. | 49/218 X |
| 3,935,674 | 2/1976 | Williams et al. | 49/216 X |
| 4,068,407 | 1/1978 | Podolan et al. | 49/215 |

FOREIGN PATENT DOCUMENTS

| | | | |
|---|---|---|---|
| 2049774 | 12/1980 | United Kingdom | 49/215 |

*Primary Examiner*—Kenneth Downey

*Attorney, Agent, or Firm*—D. D. McGraw

[57] ABSTRACT

A vehicle door is mounted to move laterally outward on parallel pivoting support arms engaging the door and the vehicle by way of rollers and tracks. The body track is parallel to the vehicle axis and the door. The door is slidably moved rearwardly and is provided with auxiliary support by a retractable and extendible auxiliary support arm moved to the support position so that the rollers enter a track on the door.

1 Claim, 10 Drawing Figures

SLIDING VEHICLE DOOR

The invention relates to a sliding door for a vehicle, and is particularly applicable to a sliding side door of a passenger vehicle. The invention is an improvement over the sliding vehicle door which is the subject of U.S. Pat. No. 4,068,407 issued Jan. 17, 1978. That patent shows a sliding vehicle door in which the front end of the door is supported by a door-mounted arm carrying rollers which roll along a track mounted under the vehicle floor. The rear end of the door is supported by another arm pivotally mounted on the vehicle body and carrying rollers which roll within two parallel tracks positioned on the interior of the door and extending for substantially the length of the door. The track mounted under the vehicle floor is positioned with its front end positioned inwardly toward the center line of the vehicle relative to its rear end. This angle provides an arrangement wherein the front edge of the door is moved laterally outward as the door is moved rearwardly in a sliding relation. Thus the door in its opening movement is angled outwardly so that its rear edge extends further away from the vehicle body than its front edge. Also the door, whether open or closed, is supported only on the two arms which are connected to the vehicle body and the tracks.

The improvement embodying the invention includes the provision of a vehicle body track immediately above the rocker panel and extending substantially parallel to the centerline of the vehicle, and therefore parallel to the door when the door is in its closed operative position, instead of being at any angle thereto. It is also positioned under the door when the door is so closed and not under the floor of part of the passenger compartment. The invention also includes an auxiliary support arm pivotally mounted on the vehicle body rearwardly of the door opening, preferably in the area of the rear quarter panel of the body. The arm has rollers mounted on an end, with the arm end having the rollers mounted thereon normally being positioned within the body panel. However, when the door is opened, a link, connected between the rearward support arm of the door and the auxiliary arm, moves the auxiliary arm pivotally so that the rollers are extended outwardly in a swinging movement during the initial kickout of the rear end of the door. The rollers mounted on the auxiliary arm will be received in an open rear end of the upper track of the door and will contribute to the support of the weight of the door in the open position.

IN THE DRAWINGS

Figure 1:
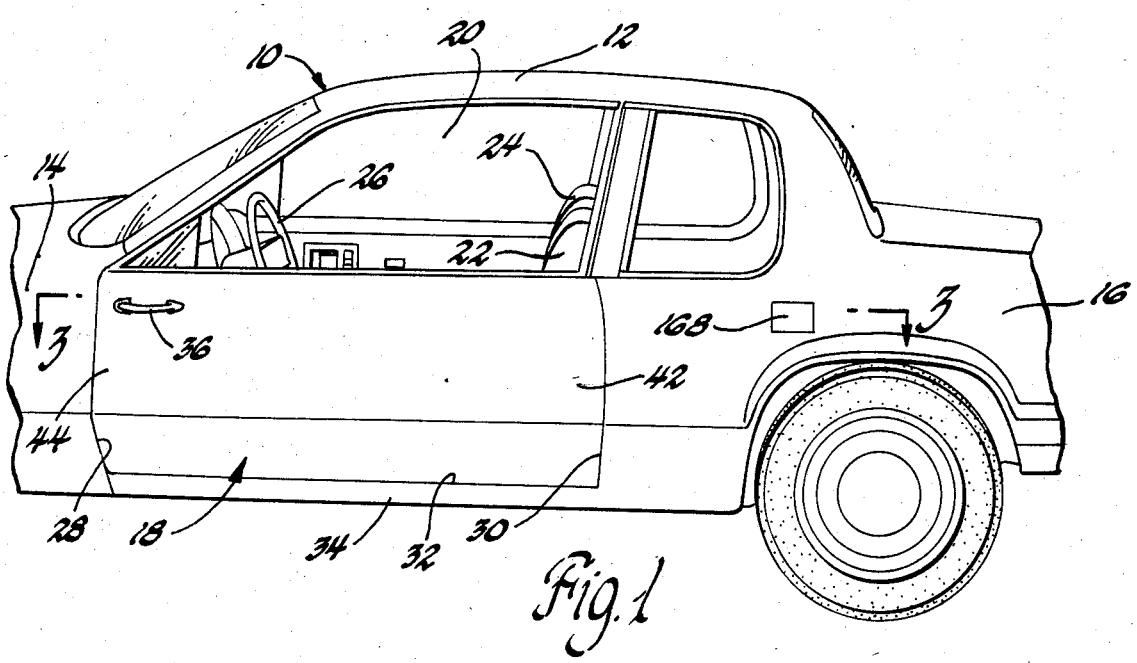
FIG. 1 is a fragmentary elevational view of a vehicle showing the subject sliding door in a closed operational position.
Figure 2:
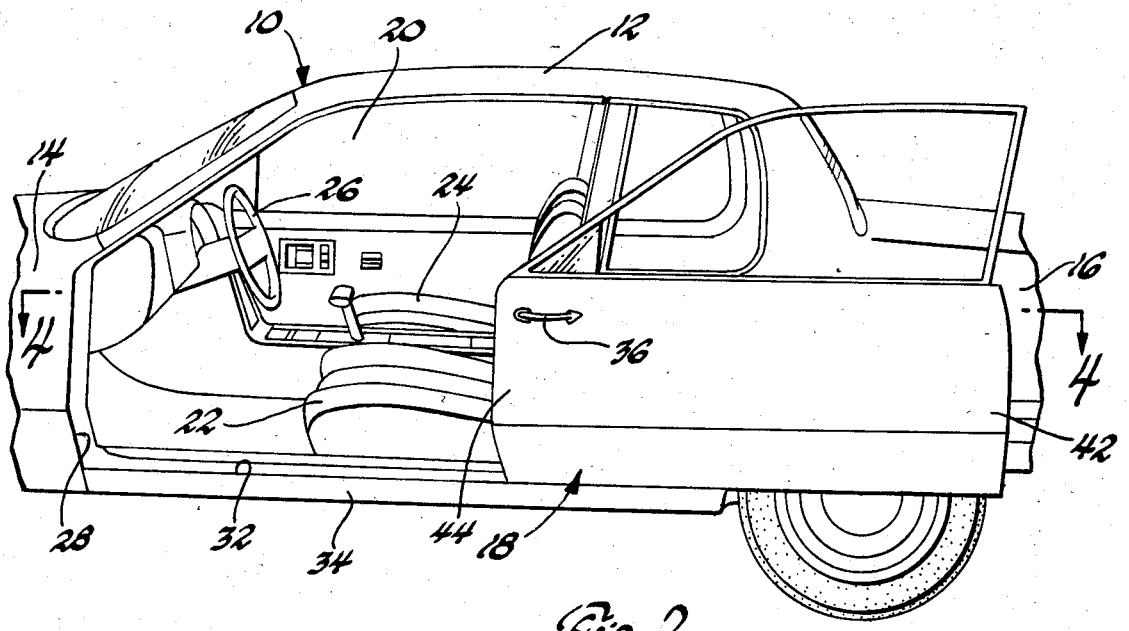
FIG. 2 is a figure like FIG. 1 but with the door in an open operational position.

In FIGS. 1 and 2, a vehicle 10 is illustrated which includes a roof portion 12, a forward side body portion or quarter panel 14, a rearward body side portion or quarter panel 16, and a side door 18. The door 18 is illustrated in its closed operative position in FIG. 1 and in an open position in FIG. 2. Door 18 encloses a passenger or interior compartment 20. It may be also used at the cargo section of a vehicle such as a van or truck. The vehicle illustrated is a passenger vehicle having a left front seat 22 and a right front seat 24 in passenger compartment 20. A steering wheel 26 is conventionally located in the forward part of compartment 20 in front of seat 22. Other vehicle controls well known in the art are provided within the vehicle compartment.

In a closed position, door 18 fills the opening formed between a forward pillar 28, a rearward pillar 30, the edge of roof portion 12, and a body bottom edge portion 32, which is formed immediately above an integral with a rocker panel 34. The door 18 is illustrated as having handle 36, and is provided with suitable opening means and lock mechanism to facilitate the usual operation of the door. As is evident from the drawings, the door 18 is not a conventionally hinged pivotal door, but is a swinging and sliding door which is particularly well adapted to permit passengers to enter the passenger compartment 20. Door 18 initially moves from its closed position laterally outward at the leading edge portion 42, which is the rear edge of the door, and then slides rearwardly as the trailing edge portion 44, which is the front edge of the door, moves to the right as seen in FIGS. 1 and 2 to provide access to compartment 20.

Figure 3:
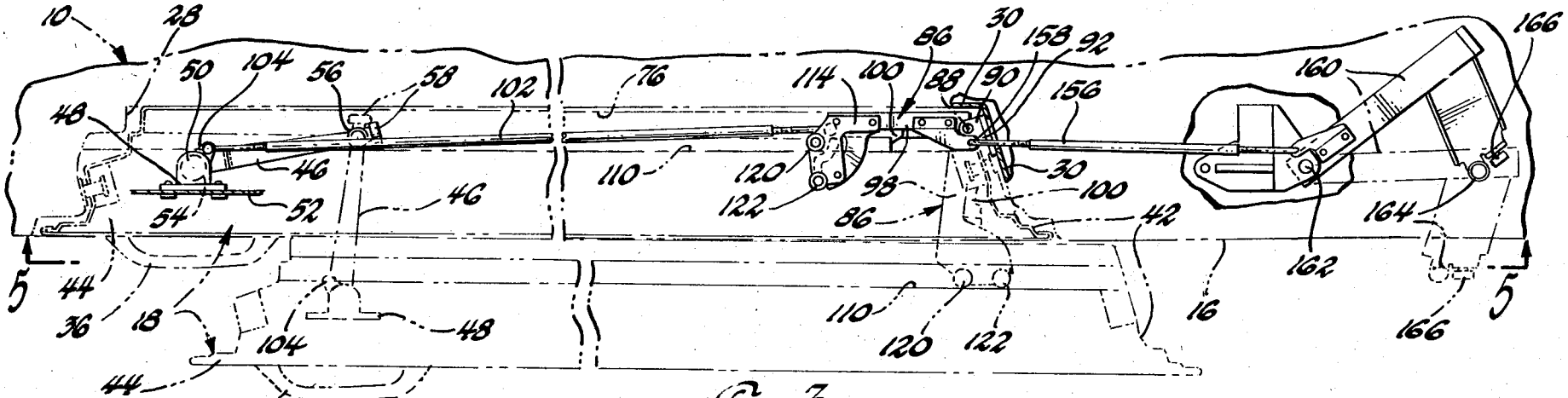
FIG. 3 is a fragmentary cross-section view of the door and a portion of the vehicle of FIG. 1, taken in the direction of arrows 3—3 of that figure and having parts shown in phantom and broken away.
Figure 4:
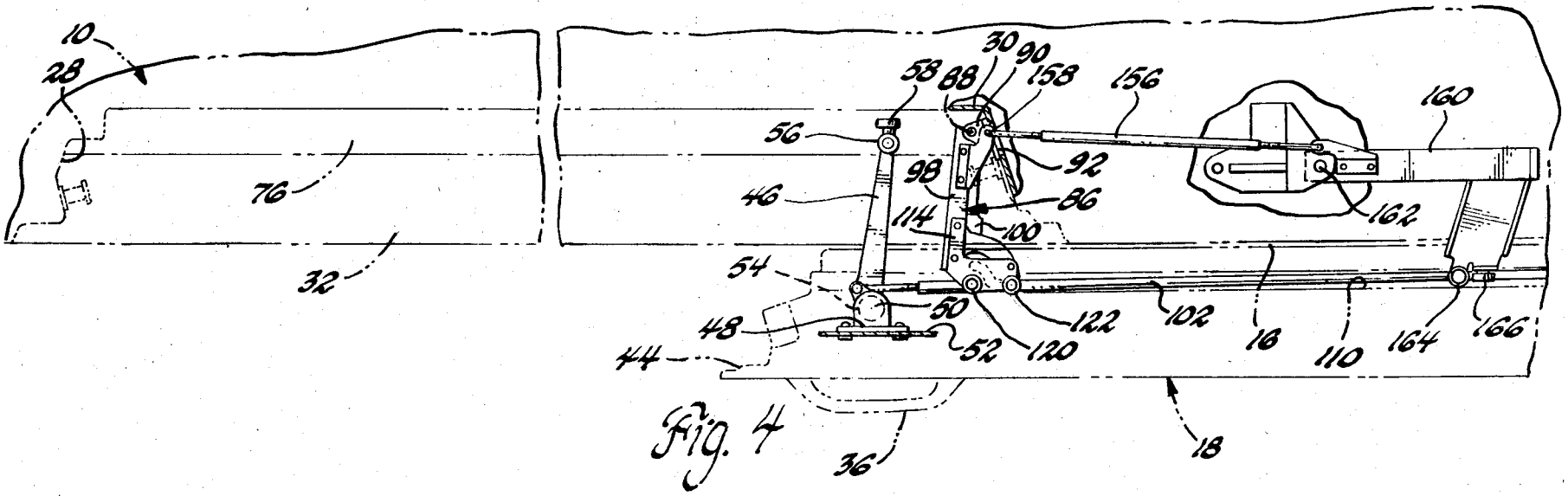
FIG. 4 is a view similar to FIG. 3, taken in the direction of arrows 4—4 of FIG. 2 and showing the door and its sliding control and support mechanism when the door is in the open operational position.
Figure 5:
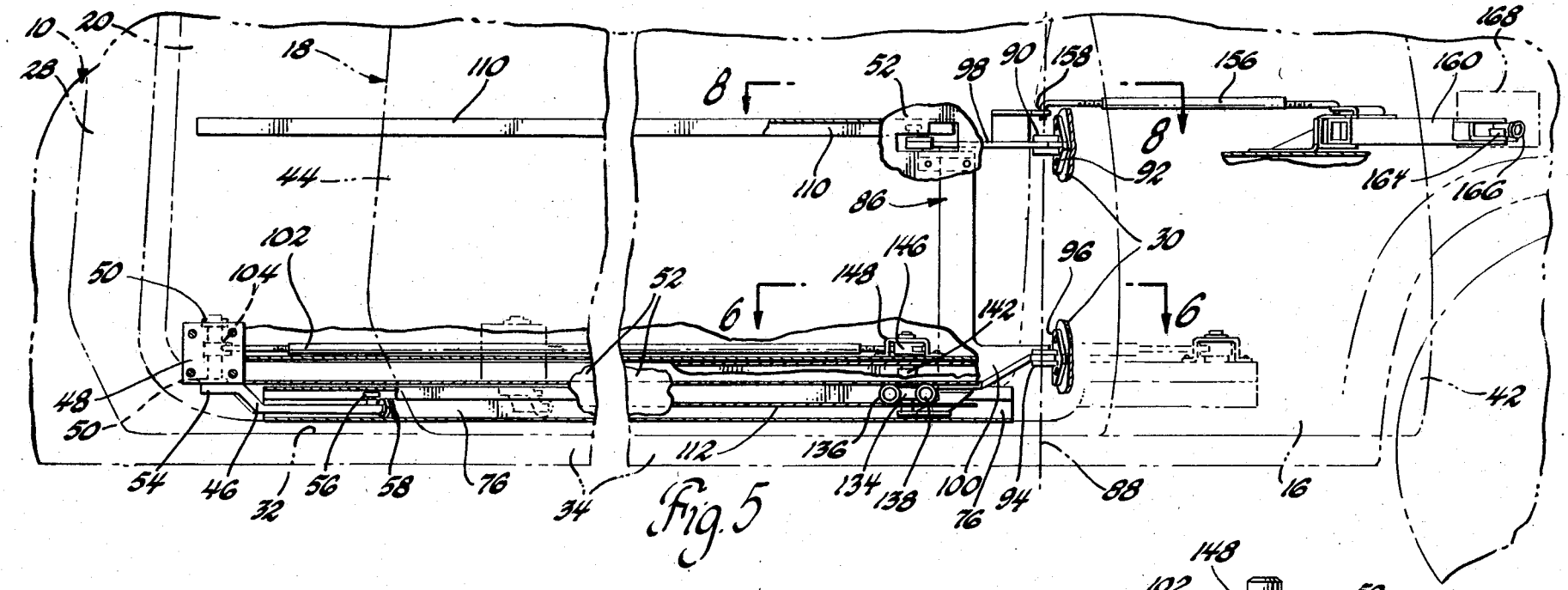
FIG. 5 is a view similar to FIG. 1 but showing the vehicle body portions, including the door, in phantom so that the sliding door guide and support mechanism is more clearly illustrated. Parts are broken away and in section.

The door 18 is supported in a vertical direction at the door trailing edge 44 by an assembly including an arm 46, best seen in FIGS. 3, 4 and 5. Arm 46 is pivotally attached to the door by a mounting plate 48 having upper and lower ears 50. The plate 48 is secured by suitable fastening means to the door inner panel 52 and suitable reinforcing plates within the door. One end 54 of the arm 46 is pivotally secured between the ears 50 so that it is capable of moving pivotally about a vertical axis passing through the ears 50. The other end of the arm 46 is provided with rollers 56 and 58 respectively mounted for pivotal movement about a vertical axis and a horizontal axis. The rollers 56 and 58 are enclosed by a generally U-shaped track 76, which is better illustrated in cross-section in FIG. 7. Track 76 has a channel-shaped inner wall portion 78 and another channel-shaped upper wall portion 80 arranged to receive and engage the rollers 56 and 58 in rolling relation. The body track 76 extends fore and aft and is substantially parallel to the door 18, as seen in FIG. 5, as well as being substantially parallel to the vehicle fore and aft centerline.

The leading edge 42 of the door 18, referred to as the leading edge since it leads as the door is being opened, is also supported by a pivotal link arm 86. As will be noted in the description below, the point of support on the door by the arm 86 moves toward the trailing edge of the door as the door is opened. Various aspects of this arrangement are illustrated in FIGS. 3 through 10. Link arm 86 is mounted on the rear pillar portion 30 of the opening in the vehicle 10. The link arm 86 is supported for pivotal movement about a vertical axis 88 by pins extending through the outwardly extending portions 90 of plate 92 and outwardly extending portions 94 of plate 96, the plates being attached to the pillar portion 30. Plate 92 is located adjacent the upper arm portion 98, and plate 96 is located adjacent the lower arm portion 100 of link arm 86. As shown in FIGS. 3 and 5, the upper and lower arm portions 98 and 100 of member 86 generally extend in a fore and aft direction when the door 18 is in the closed operative position shown in that figure. The link arm 86 is pivoted by opening movements of the door 18 to a laterally outwardly extending position shown in phantom in FIG. 3, which moves the leading edge 42 of door 18 away from the body portion 16 so that the door may slide to its open position shown in FIGS. 2 and 4. This is accomplished by control link 102, connected with arm 46 and portions of the guide and support mechanism associated with link arm 86, as will be further described below.

Portions of the door 18 are shown in solid lines and other portions are shown in phantom in various figures. In addition to the inner panel 52, which is covered by a suitable decorative member, the door has an outer panel 108. As best shown in FIG. 5, parallel upper and lower tracks 110 and 112 are attached to the inner panel 52 of the door 18. Tracks 110 and 112 extend substantially the entire length of the door 18 and are located in horizontal planes. The tracks are engaged by follower means on the ends of the upper and lower arm portions 98 and 100 to guide the door in its sliding and swinging movement.

Figure 8:
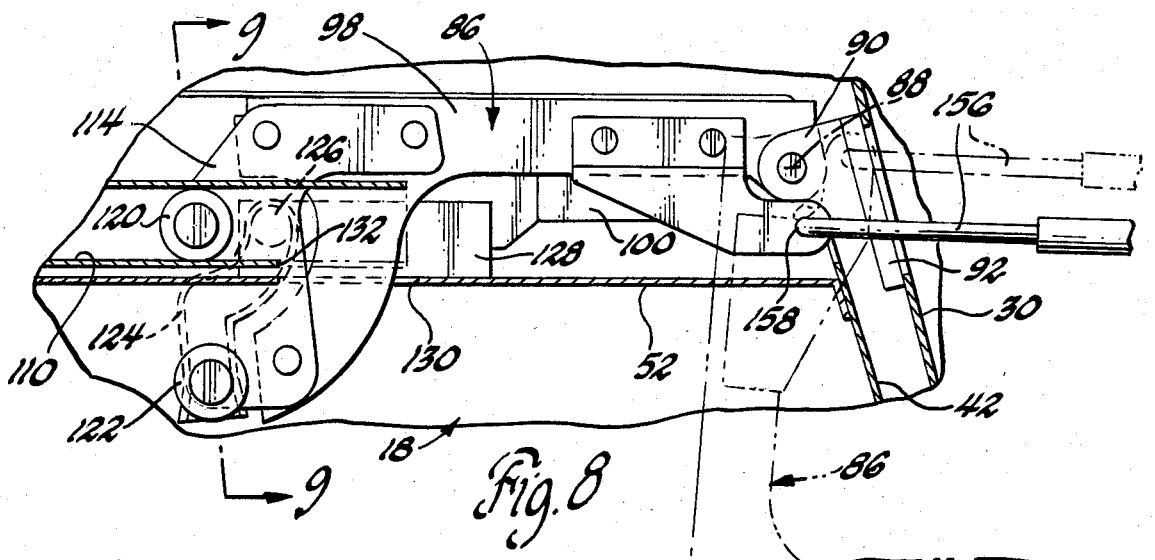
FIG. 8 is a fragmentary cross-section view taken in the direction of arrows 8—8 of FIG. 5 and illustrating another portion of the sliding door guide and support mechanism.
Figure 9:
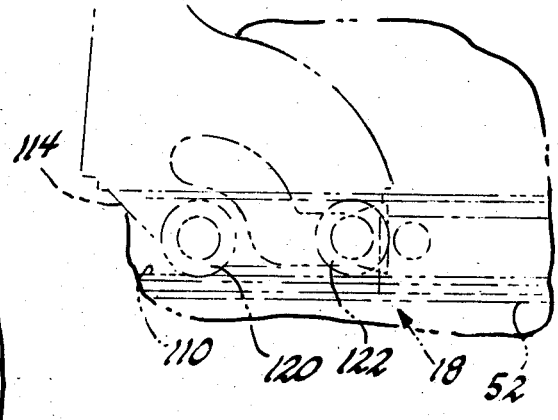
FIG. 9 is a fragmentary cross-section view taken in the direction of arrows 9—9 of FIG. 8 and showing a part of the sliding door guide and support mechanism.
Figure 9:
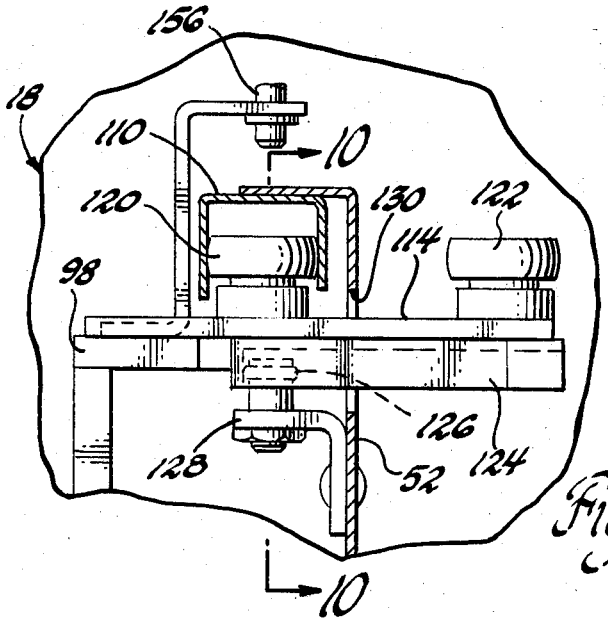
Figure 10:
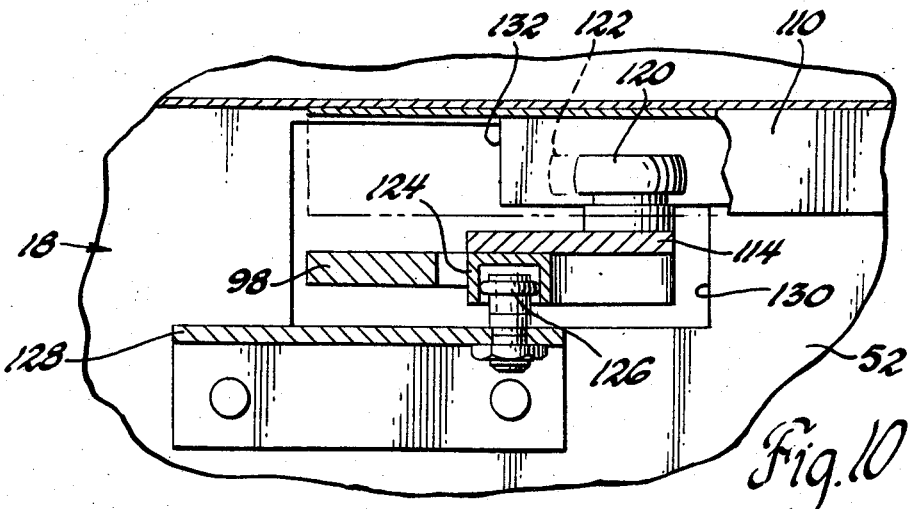
FIG. 10 is a cross-section view taken in the direction of arrows 10—10 of FIG. 9 and showing a part of the sliding door and support mechanism.

More specifically, the follower mechanism supported on the upper arm portion 98 is illustrated in greater detail in FIGS. 8, 9 and 10. The outer end of the upper arm portion 98 forms a carriage member 114, which supports first roller 120 and second roller 122. The first roller 120 is positioned in roller support and guide relation in the upper track 110, and the second roller 122 is positioned in an offset position from track 110 when the door is in the closed position illustrated in FIG. 8. A cam guide member 124 is also secured to the upper arm portion 98 and forms a part of the carriage member 114. Cam guide member 124 is shaped in a channel-like manner opening downwardly and receives a guide roller 126 therein which drives the cam guide 124 as the upper arm portion 98 is pivoted outwardly as the door is being opened. The cam guide roller 126 is mounted on a vertical axis and is rotatably secured to a bracket 128, which is in turn secured to the inner panel 52 of the door, as is the upper track 110. The door inner panel 52 is provided with a suitable opening 130 which permits the roller 122 and the portion of carriage member 114 on which it is mounted to pivot as the door is opened until the roller 122 is aligned with the upper track 110 by passing through the track opening 132 at the rearward end of track 110. This is illustrated in FIG. 8 with the upper arm mechanism being illustrated in solid lines with the door in the closed position and in phantom lines with the door in the open position. It can be seen that when the door is pivoted laterally outward to the position illustrated in phantom lines in FIG. 8, the rollers 120 and 122 are in alignment with the upper track 110 so that sliding rearward movement of door 18 will cause the track to roll on the rollers 120 and 122 in guiding relation. This is also illustrated in FIG. 3 wherein the door 18 is illustrated in phantom lines in the closed position and in the position where the arms 46 and 86 have been pivoted to extend laterally outward to support the door outside of the main body of the vehicle in preparation for sliding the door rearwardly.

The lower arm portion 100 of link arm 86 is provided with a carriage member 134. A pair of rollers 136 and 138 are mounted thereon for rotation about horizontal axes and contained in an inwardly opening portion 140 of lower track 112 so that the rollers are contained vertically against the upper and lower sides of track portion 140. Carriage member 134 also has a roller 142 rotationally mounted thereon and positioned within the channel-like downwardly opening portion 144 of lower track 112 so that roller 142 engages the sides of track portion 144 in rolling relation to prevent lateral movement of the track relative to the roller and the carriage member 134.

Figure 7:
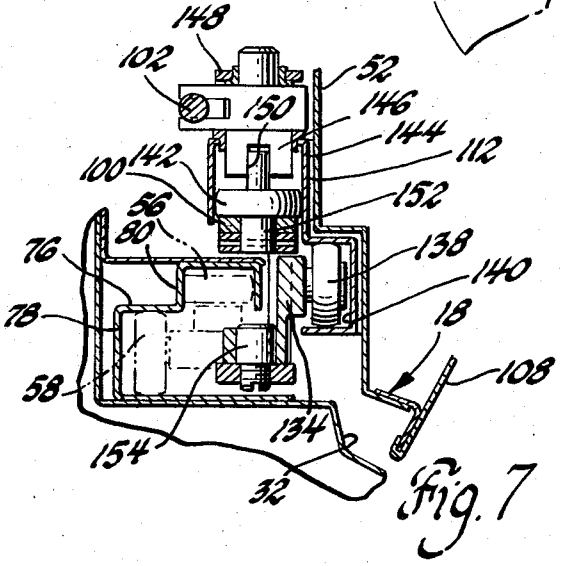
FIG. 7 is a fragmentary cross-section view taken in the direction of arrows 7—7 of FIG. 6 and illustrating another part of the sliding door guide and support mechanism.
Figure 6:
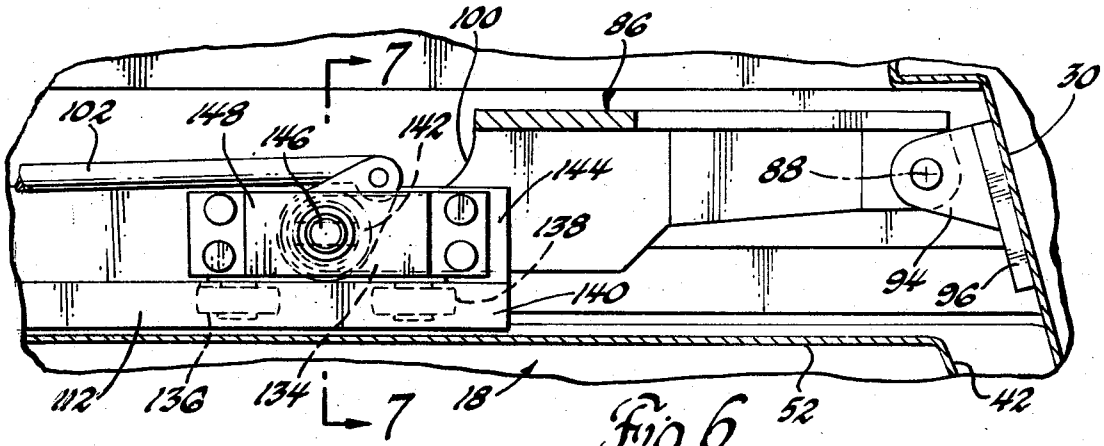
FIG. 6 is a fragmentary cross-section view taken in the direction of arrows 6—6 of FIG. 5 and showing a portion of the vehicle sliding door guide and support mechanism.

Link 102 is connected to a carriage control member 146 mounted on door inner panel 52 so that it extends into track 112. Carriage control member 146 is pivotal about a vertical axis, and is held in place on the door inner panel by a suitable strap 148. The lower end of carriage control member 146 has a slot 150 as seen in FIG. 7, and the pin 152 on which roller 142 is mounted is shaped at its upper end so as to be receivable in slot 150 in rotational driving relation. The lower portion of pin 152 extends through a part of the lower arm portion 100 of link arm 86. The carriage member 134 is pivoted on another part of the lever arm portion 100 so that it is in axial alignment with pin 152. Carriage member 134 is connected with pin 152 so as to be pivotally driven thereby to pivot the carriage member about the vertical axis of that pin when the control link is moved during the door opening action. As the door is pulled laterally outward at the beginning of the door opening phase, extended arm 46 moves as shown in FIG. 3 about the axis of roller 56 to the position shown in phantom lines in that figure. This movement also causes the arm 104, to which one end of control link 102 is pivotally secured, to move about its axis where it is pivotally mounted in ears 50. The movement of the control link 102 caused by this movement is a leftward movement in relation to the door 8, as seen in FIG. 3. Therefore the control link 102 pivots the carriage control member 146 about its vertical axis, driving pin 152 and therefore pivoting carriage member 134 about the axis of its support pins 52 and 154 to keep the rollers aligned with the track 112 as arm 100 moves to extend laterally outward. When the door has moved out laterally sufficiently to clear the main portion of the vehicle body, the slot 150 becomes aligned with track 112 and permits the carriage control member 146 to move rearwardly out of engagement with pin 152 as the carriage member 134 permits the track to move rearwardly, rolling on rollers 136 and 138. The control link 102 and the carriage control member 146, being fastened to the door inner panel 52, move rearwardly with the door toward the position shown in phantom lines in FIG. 5. When the door is being moved from the open position to the closed position, the forward movement of the door will permit the slot 150 to again pass over the upper end of pin 152 and again engage that slot and pin in driveable relation.

As particularly illustrated in FIGS. 3–5, 8 and 9, the upper arm portion 98 of link arm 86 also has a control link 156 attached thereto at pivot 158. The other end of control link 156 is pivotally connected to an auxiliary support arm 160 mounted on the vehicle body by a vertical axis pin 162. The auxiliary arm 160 has rollers 164 and 166 mounted on the other end thereof from the end where pin 162 mounts the arm. So long as the door is in the closed position, the control link 156, the auxiliary arm 160 and rollers 164 and 166 are contained within the rear quarter panel 16 of the vehicle body. A suitable door 168, which may be spring loaded toward the closed position, is provided as a part of the vehicle quarter panel 16 and is so aligned with the pivotal path of the rollers 164 and 166 that the rollers may be moved laterally outward by pivotal movement of the auxiliary arm 160, engaging and moving the door 168 and then being positioned in alignment to be received in the upper track 110 of the door 18 as the door 18 slides rearwardly. A pivotal movement of auxiliary arm 160 occurs as the link arm 86 moves pivotally from its fore and aft position to its lateral position. This movement is shown in FIG. 3 and also in FIG. 8. The movement is transmitted by movement of control link 156 to the auxiliary arm 160 to accomplish the desired movement to properly locate rollers 164 and 166 before the rear end of the door track 110 reaches the position that these rollers assume to provide auxiliary support for the door.

When the door is moved from the opened position to the closed position, link arm 86 is pivoted back to its fore and aft position, pulling control link 156 with it and moving auxiliary arm 160 pivotally to retract the rollers 164 and 166 out of track 110 and back within the vehicle rear quarter panel 16. The rearward end of track 110 may be provided with a suitable opening for the purpose of assuring the receipt and the discharge of the rollers 164 and 166 as the door 18 is opened and then closed.

The embodiments of the invention in which an exclusive property or privilege is claimed are defined as follows:

1. Support and guide mechanism for a swingable and slidable door assembly of a vehicle adapted to cover a vehicle body opening defined between forward and rearward pillars and between an upper roof edge portion and a lower body edge portion, said support and guide mechanism permitting the door to be moved translationally from a fully closed position to a fully open position while remaining substantially parallel to the body edge portions, said mechanism comprising:

extended arm means having one end pivotally attached to one end portion of the door and the other arm means end provided with guide and support roller means engaging a body track formed in the vehicle body;

said body track extending along said lower body edge portion in parallel relation to said door and positioned under said door when said door is in the closed operative position;

a link arm supporting the other end portion of said door when said door is in the closed operative position, said link arm being mounted on the other pillar member for pivotal movement about a substantially vertical axis from a closed door position in which the link arm is in a generally fore and aft orientation to an open door position in which the link arm projects laterally outward from the vehicle body;

upper and lower tracks formed in the vehicle door in vertically spaced relation and each of said upper and lower door tracks lying in a generally horizontal plane, the end of said upper door track adjacent said door leading edge having an opening adapted to have auxiliary support rollers selectively inserted into and removed from said upper door track;

said link arm having upper and lower projecting portions;

a roller carriage member supported on the end of one of said projecting portions and mounted to permit rotation about a vertical axis;

rollers supported by said carriage member for rotation about both horizontal and vertical axes for engagement with one of said tracks in said door;

a plurality of spaced pivot and guide rollers mounted on the end of the other projecting portion of said link arm and pivotal about generally vertical axes;

the first of said spaced rollers mounted in line with the axis of the other link arm projecting portion and a second of said spaced rollers being offset mounted so as to be spaced laterally outward from the first spaced roller when the link member is in a closed operative position whereby the first and second spaced rollers move into alignment with each other and the other of said door-mounted tracks as the pivotal link arm swings laterally outward from its closed door operative position;

a cam guide member adjacent the end of said other door-mounted track and having curved guide surface means extending in substantial horizontal orientation and opening to the other door-mounted track, one of said plurality of spaced rollers engaging said guide surface during swinging movement of said link arm from the laterally outward orientation of said second roller with respect to said first roller when the door is closed to the aligned orientation between said first and second spaced rollers and said other door-mounted track when said door is opening by movement of both of said first and second spaced rollers through said other door-mounted track;

and an auxiliary support arm mounted on the vehicle body rearwardly of said door opening and within the rear quarter body panel to pivot about a vertical axis and having auxiliary support rollers rotatably mounted on one end thereof, said auxiliary support arm having link means pivotally connected thereto and located within the rear quarter body panel and pivotally connecting with said link arm so that said auxiliary support arm one end extends rearwardly of the vehicle when said door is in the operative closed position, and said link means is moved by pivoting movement of said link arm when said door is moved to the door open position to extend said auxiliary support arm laterally of the vehicle through an opening in the rear quarter body panel and align said auxiliary support rollers with said upper track opening so that said auxiliary support rollers are received within said upper track and engage same in supporting relation to provide auxiliary support to said door when said door is in the open operative position.

* * * * *

UNITED STATES PATENT AND TRADEMARK OFFICE

CERTIFICATE OF CORRECTION

PATENT NO. : 4,606,146

DATED : August 19, 1986

INVENTOR(S) : Thadius F. Jozefozak

It is certified that error appears in the above—identified patent and that said Letters Patent is hereby corrected as shown below:

On the Cover Sheet, the inventor's name is misspelled; delete "Jozefozak" and insert -- Jozefczak --.

Signed and Sealed this

Twenty-fifth Day of November, 1986

*Attest:*

DONALD J. QUIGG

*Attesting Officer* *Commissioner of Patents and Trademarks*